US006553575B1

(12) United States Patent
Davenport et al.

(10) Patent No.: US 6,553,575 B1
(45) Date of Patent: Apr. 29, 2003

(54) GOLF GLOVE WITH GOLF BALL MARKER

(75) Inventors: Lanier M. Davenport, Lookout Mountain, TN (US); Dennis L. Knight, Ringgold, GA (US)

(73) Assignee: International GLUV Corporation, Chattanooga, TN (US)

( * ) Notice: Subject to any disclaimer, the term of this patent is extended or adjusted under 35 U.S.C. 154(b) by 0 days.

(21) Appl. No.: 10/021,451

(22) Filed: Oct. 29, 2001

(51) Int. Cl.[7] ..... A41D 19/00
(52) U.S. Cl. ..... 2/161.2; 2/161.1
(58) Field of Search ..... 2/161.2, 16, 20, 2/159, 161.1, 161.4, 161.5, 162; 224/918; 473/205, 406

(56) References Cited

U.S. PATENT DOCUMENTS

| | | | | | |
|---|---|---|---|---|---|
| 4,380,337 | A | | 4/1983 | DiMatteo | 273/162 D |
| RE31,538 | E | | 3/1984 | Antonious | 2/161 A |
| 4,489,444 | A | * | 12/1984 | Graham | 2/160 |
| 4,639,947 | A | * | 2/1987 | Lanscioni | 2/161.5 |
| 4,908,879 | A | | 3/1990 | Roderman | 2/161 |
| 5,276,922 | A | | 1/1994 | Floyd, Jr. | 2/160 |
| 5,282,616 | A | | 2/1994 | Stacavich-Notaro | 273/32 A |
| 5,365,609 | A | * | 11/1994 | Herzog | 2/160 |
| 5,542,126 | A | | 8/1996 | Harvanek | 2/161.2 |
| 5,569,103 | A | | 10/1996 | Sihn | 473/406 |
| 5,795,248 | A | * | 8/1998 | Giglio | 224/918 |
| 5,996,116 | A | | 12/1999 | Tate | 2/12 |
| 6,014,775 | A | * | 1/2000 | Missry | 2/161.2 |
| 6,052,828 | A | | 4/2000 | Widdemer | 2/161.2 |
| 6,163,889 | A | | 12/2000 | Tate | 2/209.13 |
| 6,170,088 | B1 | | 1/2001 | Tate | 2/209.13 |
| 6,173,451 | B1 | | 1/2001 | DeVincenzi | 2/162 |
| 6,205,588 | B1 | | 3/2001 | Shin | 2/161.4 |

* cited by examiner

*Primary Examiner*—Gary L. Welch
(74) *Attorney, Agent, or Firm*—Alan Ruderman; Stephen J. Stark; Miller & Martin LLP

(57) ABSTRACT

A golf glove including a tab which spans a slit on a back portion of the glove has a removable ball marker connected to the tab. A top surface of a ball marker is substantially flush with a ridge on the tab. A rubber insert having a hole therein receives a back surface of the ball marker within a recessed portion defined within the ridge. A socket is located within the hole of the rubber insert to receive a prong which is connected to the back surface of the ball marker.

20 Claims, 2 Drawing Sheets

GOLF GLOVE WITH GOLF BALL MARKER

FIELD OF THE INVENTION

The invention relates to golf gloves, and more particularly golf gloves with a removable ball marker attached thereto.

BACKGROUND OF THE INVENTION

Golf gloves of various designs have been manufactured for many years. Most golf gloves have a slit or spacing between two sections extending along the back of the glove and thus along the back of a user's hand which allows the user the ability to insert his or her hand into the golf glove with the fingers in the finger portions of the glove by spreading or opening the slit. Once the fingers are in position, the glove is then tightened about the user's hand by pulling the two sections together and securing the glove such as by a connecting tab extending between the sections across the slit. The tab is usually sewn to one section at one side of the slit and may utilize a hooks and loops connection, with one of the hooks or loops connected to the tab and the other connected to the glove at the section at the other side of the slit. Accordingly, the tab may be pulled to close the slit and the connection made between the sections to secure the glove to fit about the user's hand.

A number of years ago, golf glove manufacturers began to provide removable ball markers attached to the golf glove. These removable markers operate in a similar as "snap" connectors in clothing. The glove is equipped with the female connection portion, or socket, and the marker has a cooperating male fitting, or stud, on its back. The female connector is almost always located at the base of the glove near the wrist of the user and is usually located close to the slit and on the side of the slit where the tab is sewn to the glove near the wrist of the user at the small finger side of the glove. This position for some golfers may be somewhat awkward.

Moreover, in the traditional snap construction, a prong member is placed within the glove and the barbs extend through the glove. The socket member is then placed on top of the barbs and pressure is applied to secure the prong to the socket. The socket remains extending a distance beyond the outside surface of the glove. Accordingly, when the stud member is connected to the socket member, it also extends a distance beyond the exterior glove surface along with the connected ball marker. Because the ball marker extends in an unprotected manner with its bottom surface exposed above an exterior surface of the glove, it may get snagged on clothing or other items. This could result in a number of problems for the golfer including the possible inadvertent and unknowing loss of the ball marker.

Although the prior art locating of ball markers on gloves has a number of advantages, improvements can still be made.

SUMMARY OF THE INVENTION

An object of the invention is to provide a golf glove with a detachable ball marker which is on the connecting tab and may be protected in an advantageous configuration.

Another object of the invention is to provide a ball marker which resists inadvertent detachment from the glove.

Accordingly, a golf glove including a tab has a removable ball marker connected thereto. A top surface of a ball marker preferably is substantially flush with a ridge on the tab. A rubber insert having a hole therein receives a back surface of the ball marker within a recess defined within the ridge. A socket is located within the hole of the rubber insert to receive a prong which is connected to the back of the ball marker.

BRIEF DESCRIPTION OF THE DRAWINGS

The particular features and advantages of the invention as well as other objects will become apparent from the following description taken in connection with the accompanying drawings in which.

DETAILED DESCRIPTION OF THE INVENTION

Figure 2:
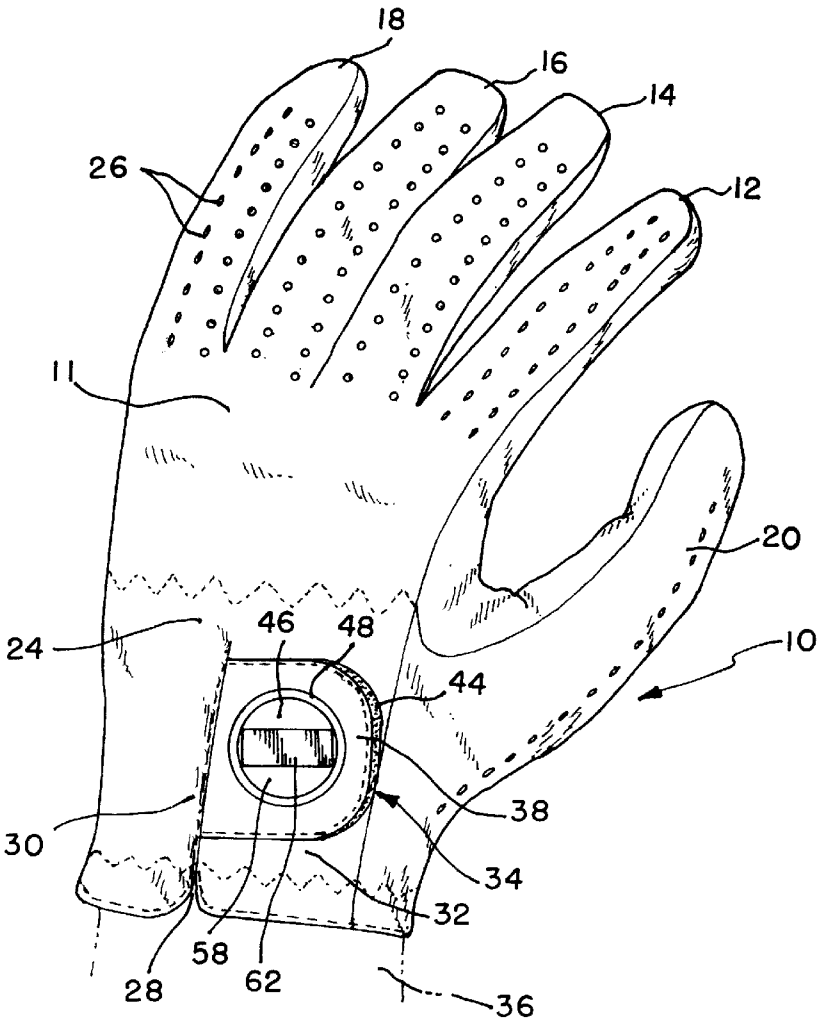
FIG. 2 is a back elevational view of the glove of FIG. 1.
Figure 1:
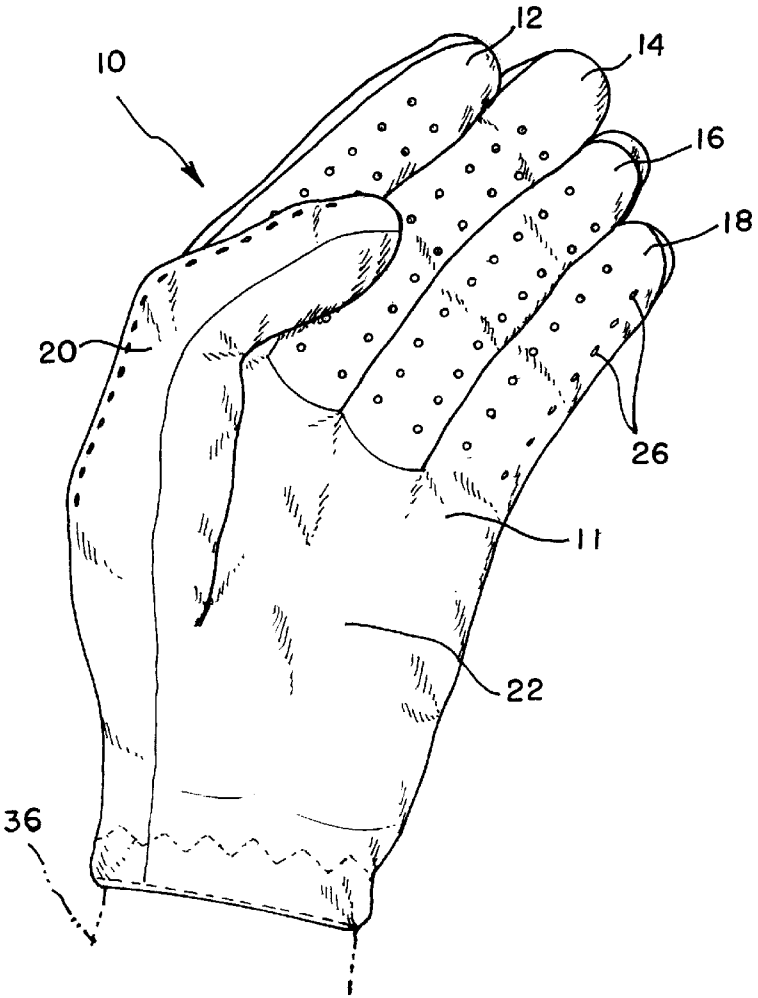
FIG. 1 is a front elevational view of a glove constructed in accordance with the invention.

FIGS. 1 and 2 show the preferred embodiment of a golf glove 10 having a covering 11 with four fingers 12,14,16,18, thumb 20, a palm portion 22 and a back portion 24. Although complete fingers 12,14,16,18 and thumb 20 are illustrated, fingertips, or other portions of the digits could be exposed through openings 26 or otherwise. Additionally, the illustrated golf glove 10 has been constructed in a Gunn cut fashion. Other golf glove construction techniques could also be utilized.

Regardless of the style of golf glove utilized, the golf glove 10 includes a back portion 24 which connects to the palm portion 22 and is opposite to the palm portion 22, extending along a back of a golfer's hand when worn. The back portion 24 usually has a slit 28 which separates a first back section 30 from a second back section 32. Although the slit 28 is illustrated centered on the back portion 24, this need not necessarily be the case. The slit 28 could even begin on the palm portion 22 and extend to the back portion 24. Other designs may include elastic webbing between the first and second back sections 30,32 or otherwise allow for the displacement of the first and second back sections 30,32 relative to one another so that the slit 28 may not be present in all golf glove designs.

When utilized, the edges of the slit 28 are typically spread apart to allow the golfer to put the golf glove 10 on his or her hand as illustrated in FIGS. 1 and 2. After putting the golf glove 10 on the hand, the first back section 30 is brought towards the second back section 32. This may be done by pulling on tab 34. This provides a "fit" of the golf glove 10 about the golfer's wrist 36, and hand, as illustrated. The tab 34 is illustrated connected to the first back section 30 by being sewn to the first back section 30. Of course there are other techniques known in the art that can be utilized to connect the first back section 30 and the tab 34.

Figure 3:
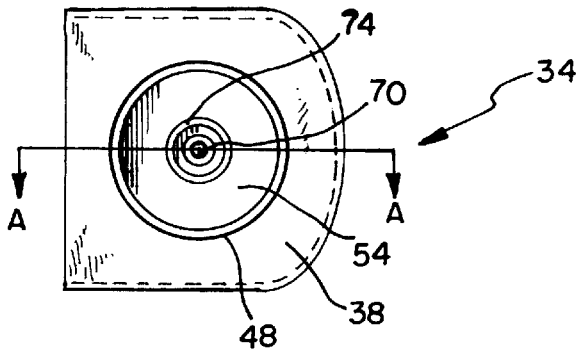
FIG. 3 is a view of the tab shown in FIG. 2 with the detachable ball marker removed.
Figure 4:
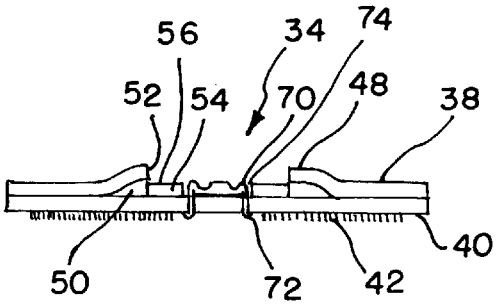
FIG. 4 is a cross sectional view along line A—A of FIG. 3.

The tab 34 has an exterior surface 38 shown in FIGS. 2, 3 and 4 and an interior surface 40 shown in FIG. 4. The tab 34 also has a first connector portion 42 shown in FIG. 4 which cooperates with second connector portion 44 shown in FIG. 2 on the second back section 32. In the preferred embodiment illustrated, the connector portions 42,44 are loops and hooks, respectively. The hooks and loops connection is commonly utilized to provide a detachable, and then reattachable connection for golf glove tabs. Other first and second connector portions 42,44 known in the art may also be utilized.

FIG. 2 shows a ball marker 46 connected to the tab 34 of the golf glove 10, while FIGS. 3 and 4 show the tab 34 with the ball marker 46 removed. Referring primarily to FIGS. 3 and 4, the exterior surface 38 of the tab 34 has a ridge 48 which is located a distance above, or beyond, a first recessed portion 50, or well. Preferably, the ridge 48 surrounds the recessed portion 50 as illustrated. Ridge walls 52 extend from the ridge 48 into the recessed portion 50. An insert 54, such as rubber insert illustrated, provides a resting surface 56 for receiving the ball marker 46 when it is connected to the golf glove 10.

Figure 5:
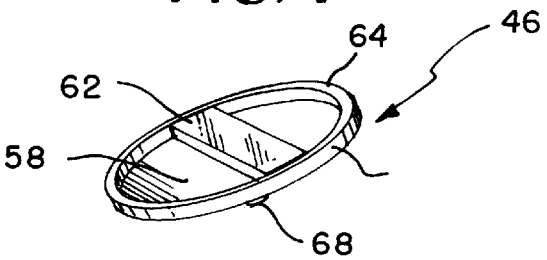
FIG. 5 is a side perspective view of a ball marker removed from the glove of FIG. 2.
Figure 6:
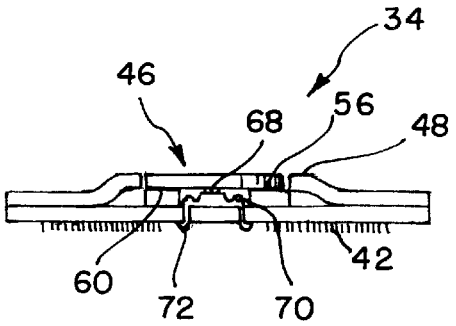
FIG. 6 is the cross sectional view of FIG. 4 with the ball marker connected to the tab.

FIG. 5 shows a ball marker 46 having an upper surface 58, the lower surface 60 is obscured from view in FIG. 5 but is visible in FIG. 6. The upper surface 58 has been stamped or embossed with a bar 62 which is representative of a design, logo, trademark, name or indicia which may be provided on a ball marker 46. The bar 62 may be raised to extend a distance above the upper surface 58 of the ball marker 46, level with or recessed a distance below the upper surface 58. A rim 64 may also extend a distance above or below the upper surface 58 of the ball marker 46. Aside surface 66 is shown extending at least partially around a perimeter of the ball marker 46.

A stud 68 extends from the lower surface 60 of the ball marker 46. The stud 68 may be integrally formed with the ball marker 48, or may be connected to the lower surface 60. The stud 68 is a third connector portion which at least assists in retaining the ball marker 48 connected to the golf glove 10. Other third connector portions could include the side surface 66 contacting the ridge wall 52, or any other connection technique known in the art that would allow for detachment and subsequent reattachment, including magnets or other connector portions.

The third connector portion, illustrated as stud 68, preferably cooperate with fourth connector portion, illustrated as socket 70 in FIGS. 3,4, and 6. The socket 70 is retained in position utilizing prong member 72 as is known in the art. Other fourth connector portions which cooperate with the third connector portion including magnets or other devices could be utilized. In that case, the insert 54 may be a magnet and function as the fourth connector portion.

The insert 54 preferably includes a second recessed portion 74, illustrated as a hole in the insert 54. This allows the resting surface 56 to be at, or above the fourth connector portion, or socket 70, illustrated. Accordingly, as illustrated in FIG. 6, the lower surface 60 of the ball marker can rest against the resting surface 56 when the third and fourth connector portions are connected. Additionally, the lower surface 60 of the ball marker 46 is located below the ridge 48. The upper surface of the ball marker 46 is also preferably located at or below the ridge 48. Furthermore, the bar 62, or the tallest portion of the ball marker 62, whichever is taller, is shown in FIG. 6 as being located at or below the ridge 48 when the ball marker 46 is connected to the tab 34. By locating the lower surface 60 below the ridge 48, it is less likely that the ball marker 46 may be snagged inadvertently and lost. By locating the upper surface 58 at or below the ridge 48, there is even less of an opportunity to inadvertently disconnect the ball marker 46 from the glove 10.

The side surface 66 of the ball marker 46 preferably abuts, adjoins, or is at least located close, to the ridge wall 52. Very little, if any of the insert 54 is preferably visible. This construction has been found to provide a professional configuration. Accordingly, the perimeter of the ball marker 46 is proximate to a perimeter of the ridge 48.

By utilizing standard third and fourth connector portions are utilized, such as studs 68 and sockets 70, i.e., male and female couplers, ball markers 46 may be sold independently of the golf gloves 10. This would provide the opportunity for "custom" gloves to be sold at a fraction of the costs of having small runs of custom gloves. A standard glove may be made, and the ball markers may be custom made to provide a custom product. The ball markers 46 are preferably on the order of about one inch so that an identifiable representation may be provided on the upper surface 58 and/or the bar 62, if utilized.

While the invention has been described above with respect to certain embodiments thereof, it will be appreciated that variations and modifications may be made without departing from the spirit and scope of the invention. Numerous alternations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A golf glove comprising:

a palm portion and a back portion, said back portion having a first back section and a second back section;

a tab connected to the first back section and detachably connectable to the second back section, said tab having an interior and an exterior surface, the tab having a first connector portion which cooperates with a second connector portion on the second back section, and the exterior surface having a ridge located above a first recessed portion and the exterior surface of the tab; and a ball marker having an upper surface, a lower surface, and a stud extending away from the lower surface, said stud at least assisting in securing the ball marker to the glove when attached and at least assisting in subsequent reconnection after disconnection from the golf glove, said stud obscured from view by at least one of the ridge and the upper surface of the ball marker when secured to the glove, and said lower surface located below the ridge when the ball marker is connected to the glove.

2. The golf glove of claim 1 further comprising a fourth connector portion located within said first recessed portion, said fourth connector portion cooperating with said stud to secure the ball marker to the glove when the ball marker is connected to the glove.

3. The golf glove of claim 1 wherein the ball marker further comprises a perimeter and the perimeter of the ball marker substantially coincides with a perimeter of the ridge.

4. The golf glove of claim 1 wherein said upper surface is located below the ridge when the ball marker is connected to the glove.

5. The golf glove of claim 1 wherein the ball marker further comprises a perimeter and the ridge further comprises a perimeter and the perimeter of the ball marker is similar in shape to the perimeter of the ridge.

6. A golf glove comprising:

a palm portion and a back portion, said back portion having a first back section and a second back section;

a tab connected to the first back section and detachably connectable to the second back section, said tab having an interior and an exterior surface, the tab having a first connector portion which cooperates with a second connector portion on the second back section, and the exterior surface having a ridge located above a first recessed portion and the exterior surface of the tab; and a ball marker having an upper surface, a lower surface, and a stud extending away from the lower surface, said stud at least assisting in securing the ball marker to the glove when attached and at least assisting in subsequent reconnection after disconnection from the golf glove, and said lower surface located below the ridge when the ball marker is connected to the glove; and an insert located within the first recessed portion.

7. The golf glove of claim 6 wherein the insert is a rubber insert.

8. The golf glove of claim 6 wherein the insert further comprises a second recessed portion and said second recessed portion contains a fourth connector portion, said fourth connector portion cooperating with said stud to secure the ball marker to the glove when the ball marker is connected to the glove.

9. The golf glove of claim 6 wherein the rubber insert further comprises a hole and a fourth connector portion is located within said hole, said fourth connector cooperating with said stud to secure the ball marker to the glove when the ball marker is connected to the glove.

10. The golf glove of claim 6 wherein the first recessed portion is substantially circular and the insert extends proximate to the ridge.

11. A golf glove comprising:

a palm portion and a back portion, said back portion having a first back section and a second back section;

a tab connected to the first back section and detachably connectable to the second back section, said tab having an interior and an exterior surface, the tab having a first connector portion which cooperates with a second connector portion on the second back section, and the exterior surface having a ridge located above a first recessed portion and the exterior surface of the tab; and a ball marker having an upper surface, a lower surface, and a stud extending away from the lower surface, said stud at least assisting in securing the ball marker to the glove when attached and at least assisting in subsequent reconnection after disconnection from the golf glove, and said lower surface located below the ridge when the ball marker is connected to the glove; and wherein the ridge is raised relative to the exterior surface of the tab.

12. The golf glove of claim 11 wherein the perimeter of the ball marker is adjacent the perimeter of the ridge.

13. A golf glove comprising:

a palm portion and a back portion, said back portion having a first back section and a second back section;

a tab connected to the first back section and detachably connectable to the second back section, said tab having an interior and an exterior surface, the tab having a first connector portion which cooperates with a second connector portion on the second back section, and the exterior surface having a ridge located above a first recessed portion and the exterior surface of the tab said first recessed portion having a fourth connector portion located therein;

a ball marker having an upper surface, a lower surface, and a third connector portion extending away from the lower surface, said stud at least assisting in securing the ball marker to the glove when attached and at least assisting in subsequent reconnection after disconnection from the golf glove, and said lower surface located below the ridge when the ball marker is connected to the glove; and the third connector portion is a stud and the fourth connector portion is a socket.

14. A golf glove comprising:

a palm portion and a back portion, said back portion having a first back section and a second back section;

a tab connected to the first back section and detachably connectable to the second back section, said tab having an interior and an exterior surface, the tab having a first connector portion which cooperates with a second connector portion on the second back section, and the exterior surface having a ridge located above a first recessed portion and the exterior surface of the tab;

a ball marker having an upper surface, a lower surface, and a stud extending away from the lower surface, said stud at least assisting in securing the ball marker to the glove when attached and at least assisting in subsequent reconnection after disconnection from the golf glove, and said lower surface located below the ridge when the ball marker is connected to the glove; and a ridge wall separating the ridge from the first recessed portion, and said ball marker further comprising a side surface, and said side surface located within said ridge wall.

15. A golf glove comprising:

a palm portion and a back portion having a first back section and a second back section;

a selectively closeable connection on the back portion connecting the first back section to the second back section utilizing a tab connected to the first back section, said tab having a first connection portion which cooperates with a second connection portion on the second back section, the selectively closeable connection permitting the glove to receive a hand when the tab is not connected, and securing the glove on the hand when connected;

a well recessed into said tab, said well having an outer perimeter for receiving a ball marker into the well and an upper and lower surface, a first connector within said well, and a ball marker having an upper surface, a lower surface, and a second connector, said second connector located on the lower surface and receivable within said well with said second connector coupled to said first connector and said upper surface of said ball marker located above the second connector when the second connector is coupled to the first connector, and said lower surface of said ball marker located below the upper surface of the well when the ball marker is connected to the glove.

16. The golf glove of claim 15 wherein said well has a depth such that when the ball marker is received therein a surface of the ball marker is substantially at an exterior surface of the tab.

17. The golf glove of claim 13 wherein a perimeter of said well is substantially circular.

18. The golf glove of claim 15 wherein said first connector is a female member and said second connector is a male connector member.

19. A golf glove comprising:

four fingers, a thumb, a palm portion and a back portion, said back portion having a first back section and a second back section;

a tab connected at the first back section, said tab having an interior and an exterior surface portion, the interior surface portion having a first connector portion which cooperates with a second connector portion on the second back section; and a removable ball marker having an upper surface, a lower surface, and a third connector portion, said third connector portion securing the ball marker to a fourth connector portion on the tab when attached and allowing for subsequent reconnection after disconnection, and said third and fourth connection portions obscured from view by the upper surface of the ball marker when connected to the tab, and said lower surface of said ball marker located below the exterior surface portion of the tab when the ball marker is connected to the glove.

20. A glove comprising:

a palm portion and a back portion, said back portion having a first back section and a second back section;

a tab connected to the first back section and detachably connectable to the second back section, said tab having an interior and an exterior surface, the tab having a first connector portion which cooperates with a second connector portion on the second back section, and the exterior surface having a ridge located above a first recessed portion; and an identification piece having an upper surface, a lower surface, and a third connector portion, said third connector portion at least assisting in securing the identification piece to the glove when attached and at least assisting in subsequent reconnection after disconnection from the glove, and said lower surface located below the ridge when the identification piece is connected to the glove, said third connector portion located below the upper surface of the identification piece and obscured from view when the identification piece is connected to the glove.

* * * * *